US006262946B1

(12) United States Patent
Khuri-Yakub et al.

(10) Patent No.: US 6,262,946 B1
(45) Date of Patent: Jul. 17, 2001

(54) CAPACITIVE MICROMACHINED ULTRASONIC TRANSDUCER ARRAYS WITH REDUCED CROSS-COUPLING

(75) Inventors: Butrus T. Khuri-Yakub, Palo Alto; F. Levent Degertekin, Millbrae, both of CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 0 days.

(21) Appl. No.: 09/408,156

(22) Filed: Sep. 29, 1999

(51) Int. Cl.[7] ..... H04R 19/00

(52) U.S. Cl. ..... 367/181; 367/153; 367/174; 381/174; 381/191

(58) Field of Search ..... 367/174, 176, 367/153, 181; 381/174, 423, 424, 425, 191

(56) References Cited

U.S. PATENT DOCUMENTS 5,129,262 7/1992 White et al. ..... 73/599
5,870,351 2/1999 Ladabaum et al. ..... 367/163
5,894,452 4/1999 Ladabaum et al. ..... 367/163
6,109,113 * 8/2000 Chavan et al. ..... 73/718

OTHER PUBLICATIONS

Ladabaum, I. et al., "Micromachined Ultrasonic Transducers (MUTs)" (9/95).

Eccardt et al., "Micromachined Transducers for Ultrasound applications," IEEE Ultrasonics symposium, pp. 1609–1618, 1997.*

Larson, "Non–ideal Radiators in phased array transducers" IEEE Ultrasonics symposium, pp. 673–684, 1981.*

* cited by examiner

*Primary Examiner*—Ian J. Lobo
(74) *Attorney, Agent, or Firm*—Flehr Hohbach Test Albritton & Herbert LLP

(57) ABSTRACT

There is described a capacitive micromachined ultrasonic transducer array which is configured to minimize the excitation and propagation of plate waves traveling in the substrate and ultrasonic waves propagating at the interface between the array surface and the immersion fluid.

15 Claims, 7 Drawing Sheets

CAPACITIVE MICROMACHINED ULTRASONIC TRANSDUCER ARRAYS WITH REDUCED CROSS-COUPLING

GOVERNMENT SUPPORT

This invention was made with Government support under Contracts N00014-96-1-1099, N00014-98-106 awarded by the Department of the Navy ONR. The Government has certain rights in this invention.

BRIEF DESCRIPTION OF THE INVENTION

This invention relates generally to capacitive micromachined ultrasonic transducers, and more particularly to transducers and transducer arrays in which the cross-talk or cross-coupling is minimized.

BACKGROUND OF THE INVENTION

Capacitive micromachined ultrasonic transducers have been emerging as an attractive alternative to piezoelectric transducers. They offer a larger set of parameters for optimization of transducer performance as well as ease of fabrication and electronic integration. The fabrication and operation of micromachined ultrasonic transducers have been described in many publications and patents. For example, U.S. Pat. Nos. 5,619,476; 5,870,351 and 5,894,452, incorporated herein by reference, describe the fabrication of capacitive-type ultrasonic transducers in which membranes are supported above a substrate by insulative supports such as silicon nitride, silicon oxide and polyamide. The supports engage the edges of each membrane. A voltage applied between the substrate and a conductive film on the surface of the membrane causes the membrane to vibrate and emit sound waves. The membranes can be sealed to provide operation of the transducers immersed in a liquid. The transducer may include a plurality of membranes of the same or different sizes and/or shapes. In operation, one or more multi-element transducers can be in arrays with the electrical excitation controlled to provide desired beam patterns.

The ultrasonic energy in the substrate is in the form of guided plate waves (Lamb waves) which radiate from the surface and propagate in the substrate resulting in cross-coupling between transducers of the array. These waves disturb the beam profile of the acoustic energy generated by the transducer especially at the critical radiation angle of the plate waves to the fluid medium. Ultrasonic waves propagating at the fluid-solid interface are also generated and propagated predominantly in the fluid along the transducer surface to disturb the beam pattern. These interface waves generated by an active transducer start an undesired vibration of the neighboring transducers after a time delay, effectively reducing the imaging bandwidth of the array in addition to the beam pattern disturbances.

OBJECTS AND SUMMARY OF THE INVENTION

It is a general object of the present invention to provide ultrasonic transducer arrays with minimum acoustic cross-coupling between array elements.

It is a further object of the present invention to provide a transducer array in which cross-coupling between transducer elements through the supporting substrate is minimized.

It is still a further object of the present invention to provide a transducer array in which cross-coupling of ultrasonic waves propagating along the fluid-solid interface is minimized.

There is described a capacitive micromachined ultrasonic transducer array in which the direction or magnitude of the cross-coupled ultrasound is altered to minimize cross-coupling.

BRIEF DESCRIPTION OF THE DRAWINGS

The foregoing and other objects of the invention will be more clearly understood from the following description when read in connection with the accompanying drawings in which.

DESCRIPTION OF THE PREFERRED EMBODIMENT

Figure 1:
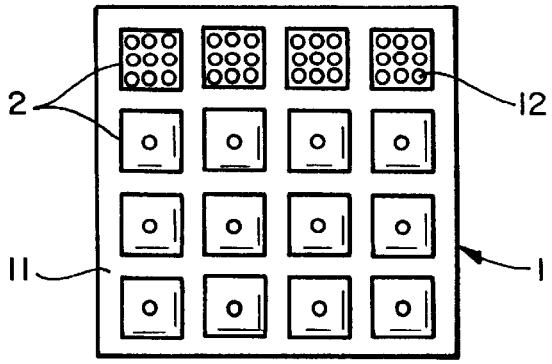
FIG. 1 is a schematic plan view of a capacitive micromachined ultrasonic transducer array.
Figure 2:
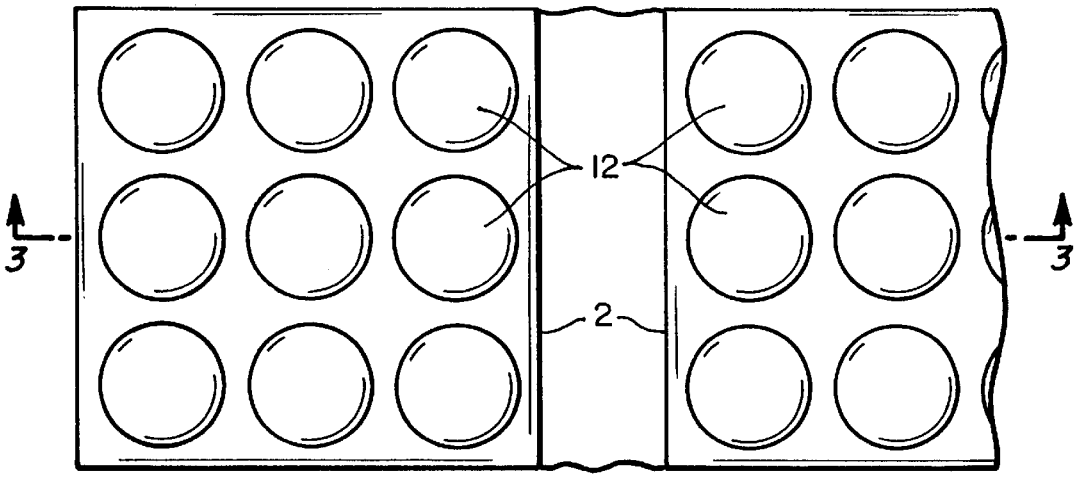
FIG. 2 is an enlarged view of one, and a portion of another, of the elements of the transducer array of FIG. 1.
Figure 3:
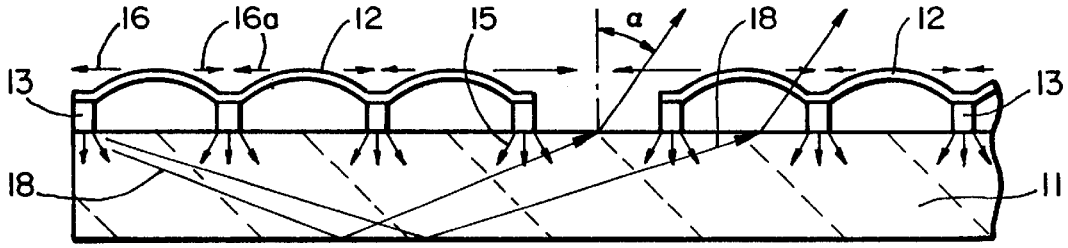
FIG. 3 is an enlarged cross-sectional view taken along the line 3—3 of the transducer array of FIG. 1 formed on a thick substrate showing schematically the cross-coupling of ultrasonic energy between elements of the array.
Figure 4:
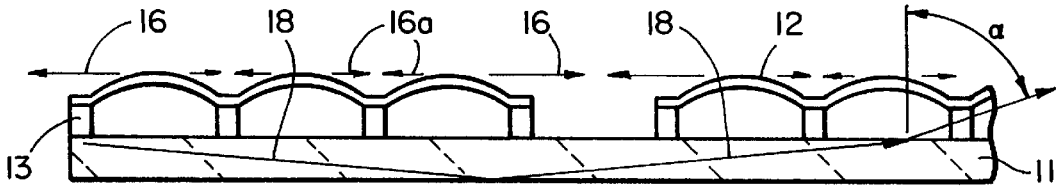
FIG. 4 is an enlarged cross-sectional view of the array of FIG. 3 with a thin substrate showing schematically the cross-coupling of the ultrasonic energy between elements of the array.

A transducer array 1 is shown in FIG. 1. The array includes a number of individual transducer elements 2 which may include multiple membranes 12, in this instance circular membranes. The transducer elements are formed on a common substrate. An enlarge view of two transducer elements 2 of a typical capacitive micromachined ultrasonic transducer (cMUT) array is shown in FIG. 2. FIGS. 3 and 4 are sectional views taken along the lines 3—3 and 4—4, respectively. The membranes 12 are shown in their extended positions. The cMUT array includes a substrate 11 which may comprise highly doped silicon. The plurality of membranes 12 may be silicon nitride supported above the substrate by supports 13 made of insulating material such as silicon oxide, silicon nitride, etc. The membranes are provided with a conductive film which may be deposited and etched to define top electrode, not shown, and connections to the electrodes. The cMUT array is operated by applying a high frequency voltage between the substrate and the electrodes whereby to cause the membranes to flex and generate ultrasonic waves which travel into the medium in which the cMUT array is immersed. The shape of the membranes can be selected to suit various applications. By way of example, they can be square, circular, rectangular, hexagonal, etc. Multiple membranes are generally employed to form a transducer element, and multiple transducer elements can be arranged in arrays. By selective excitation of the membranes the arrays will emit a predetermined ultrasound pattern which can be electronically scanned by controlling the applied voltages.

Figure 5:
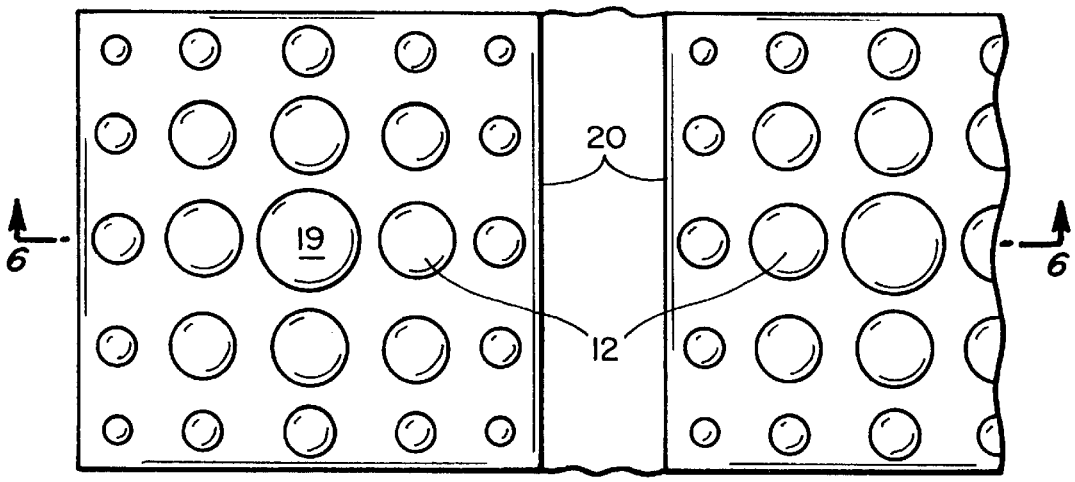
FIG. 5 is a plan view of a portion of a transducer array where the transducer elements are apodized.
Figure 6:
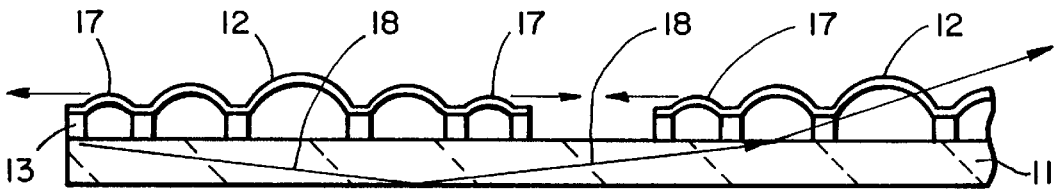
FIG. 6 is a sectional view of the transducer of FIG. 4 showing the membranes.

As the membranes vibrate they displace the fluid medium, gas or liquid, in contact therewith to generate ultrasound waves. A majority of the energy is emitted in a direction substantially perpendicular to the surface of the transducer array. However, ultrasonic waves are also generated at the attachment edge of the membranes which, because of the curvature of the membrane, travel along the fluid-solid medium as indicated by the arrows 16, FIGS. 3 and 4. These waves can be compressional waves or interface waves like Stoneley waves, and are generated mainly by the in-plane motion of the fluid around the edges of the cMUT array element membranes. The waves indicated by arrows 16*a* between adjacent membranes tend to cancel, leaving the edge waves 16. Surface waves 16 cross-couple with the waves from adjacent transducer elements and alter the beam profile. The surface wave cross-talk can be minimized by apodizing the elements or membranes as shown in FIG. 5, and sectional view, FIG. 6, where the membranes decrease in size from the center 17 of the array element toward the edge 18 of the array. This reduces the slope of the membrane displacement of the of the outer membranes 17, FIG. 6.

Figure 7:
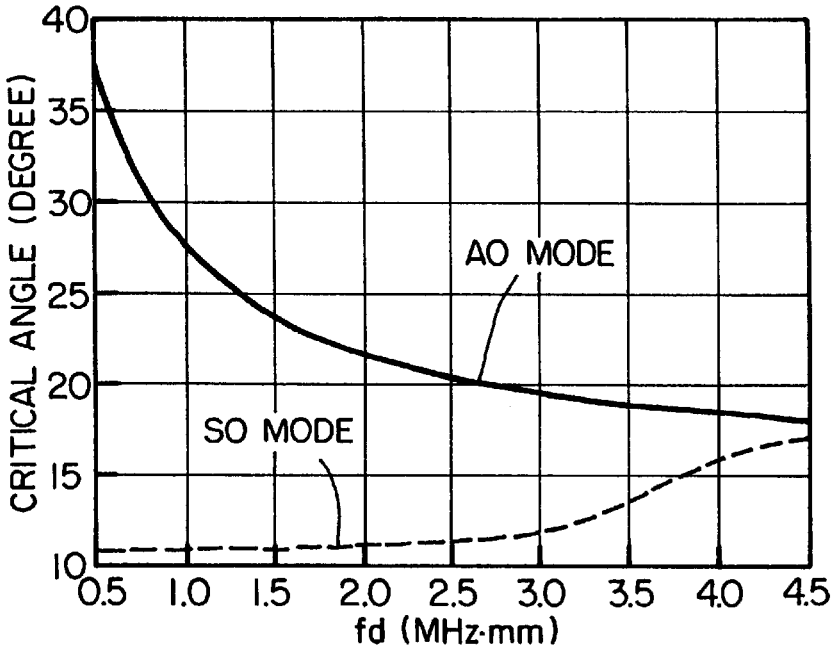
FIG. 7 shows the relationship of the critical angle $\alpha$ as a function of frequency of the ultrasound energy and the thickness of the substrate.
Figure 8:
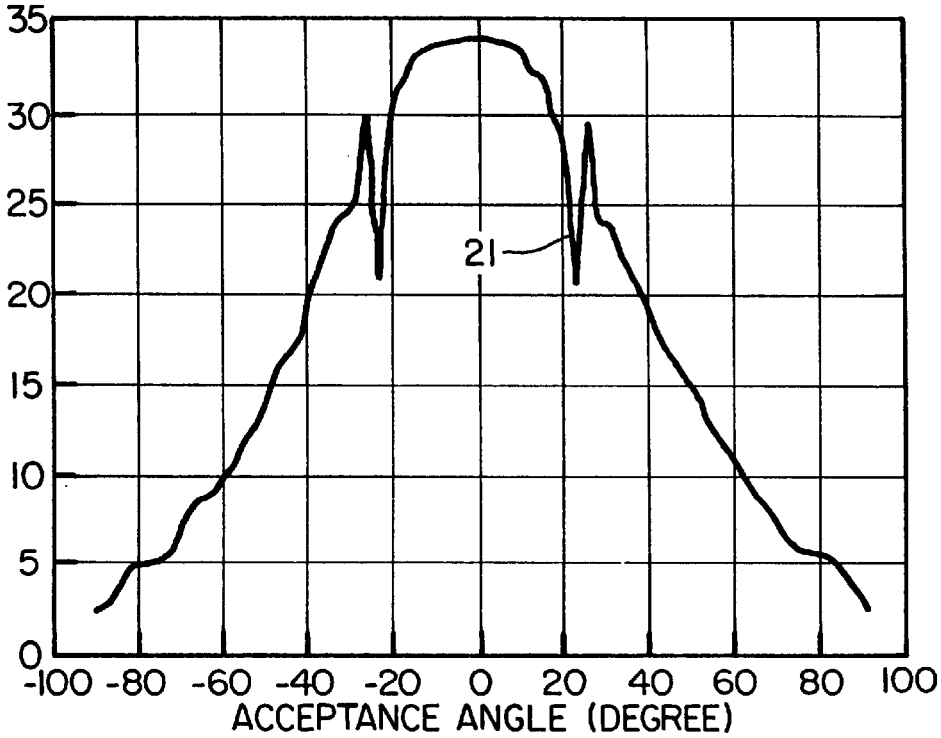
FIG. 8 shows the acceptance angle of a line element having a substrate of a first thickness.

A second and more important cause of cross-coupling arises from ultrasound generated in the support and coupled to adjacent transducers by Lamb waves 18 which travel along the substrate, FIGS. 3 and 4. The Lamb waves are generated by supports 13 as they are moved by the membranes. The arrows 18 schematically show the forces which generate the ultrasound waves indicated by the arrow 17. As is known, the Lamb waves propagate or travel along the plate. When the thickness d of the substrate is smaller than the wavelength of propagation along the plate the two lowest order modes (A0 and S0) propagate. When the plate is immersed in a fluid, the Lamb waves radiate into the surrounding medium. The angle $\alpha$ of radiation depends upon the frequency of the waves and the thickness of the substrate. FIG. 7 shows the relationship of the critical angle $\alpha$ as a function of f×d, where f is the frequency of the ultrasonic Lamb waves and d is the thickness of the substrate. In order to minimize the interference, the thickness of the substrate is chosen so that the emitted sound is at an angle $\alpha$, FIGS. 3 and 4, outside the main lobe of the ultrasonic beam. FIG. 8 shows the acceptance angle of a line element showing the effect of cross-talk as a dip 21.

Figure 9:
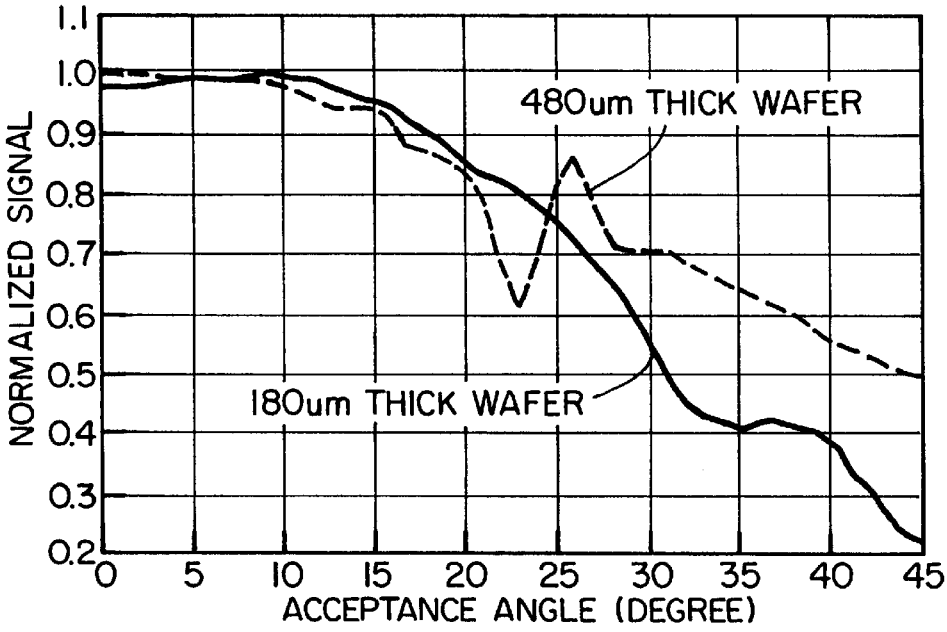
FIG. 9 shows the acceptance angle of a line element with a thinner substrate.

The desired angular span of the ultrasonic beam generated by the array determines the thickness of the substrate to avoid disturbances due to plate waves, especially the A0 mode, which is very dispersive in the typical ultrasonic imaging frequency range. FIG. 7 depicts the critical angle of the A0 and S0 modes as a function of the frequency thickness product (f×d) for a silicon substrate immersed in water. As an example, an ultrasonic array operating at 4 MHz with a desired maximum acceptance angle of ±30° should have f×d<0.75 MHz×mm, i.e. the thickness of the substrate should be smaller than 0.185 mm. For a 3 MHz transducer array with the same angular specifications, the thickness should be smaller than 0.25 mm to avoid the A0 mode radiation. Similarly, for ±35° acceptance angle at 4 MHz, the thickness should be less than 0.125 mm. FIG. 9 shows the effect of substrate thinning on the beam pattern of an array transducer at 4 MHz. Corresponding critical angle curves like FIG. 7 can be generated for different substrate materials and fluid media.

Figure 10:
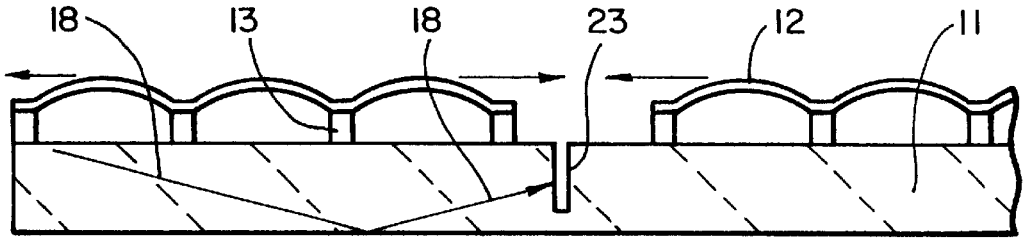
FIG. 10 shows interrupting the cross-coupling by providing a slot in the substrate to interrupt the Lamb waves.
Figure 11:
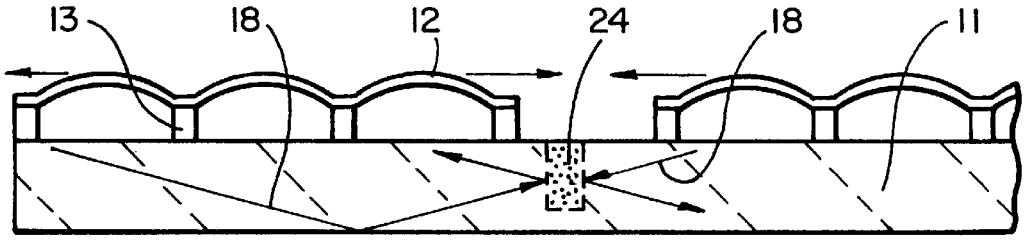
FIG. 11 shows interrupting the cross-coupling by porous material in the substrate between elements.

Another method for reducing cross-coupling through the substrate is to etch a channel 23 surrounding the transducer elements as illustrated in FIG. 10. Another method of reducing the cross-coupling is to make the substrate between transducer elements porous, as shown at 24, FIG. 11. A porous substrate has a small impedance compared to a solid substrate and will therefore provide acoustic isolation between array elements.

Figure 12:
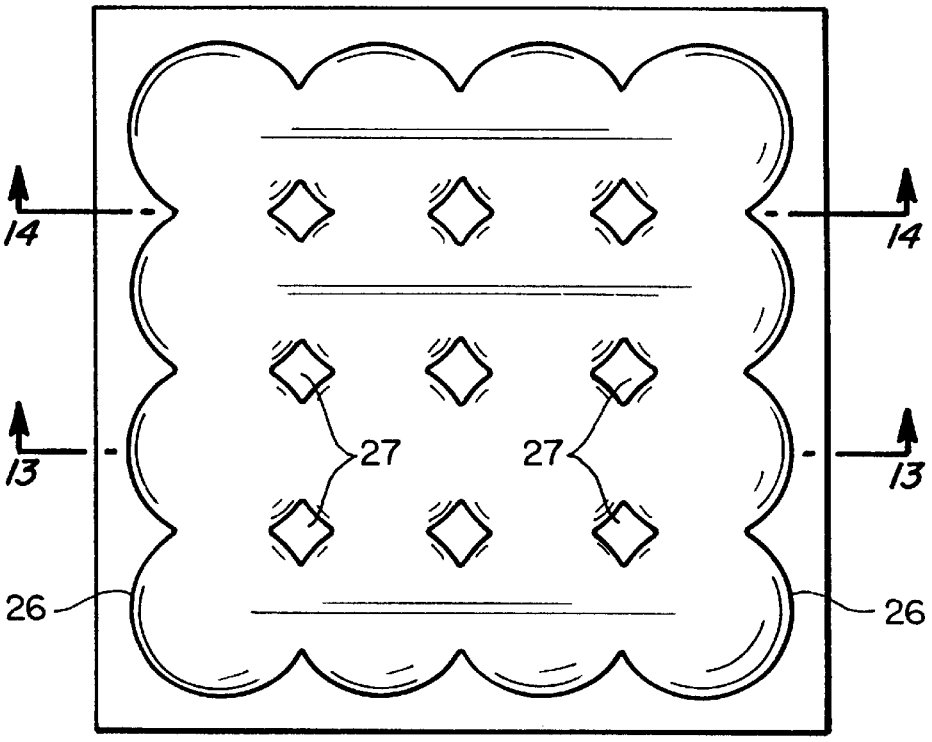
FIG. 12 shows a transducer element in which membranes merge and are supported by posts.
Figure 13:
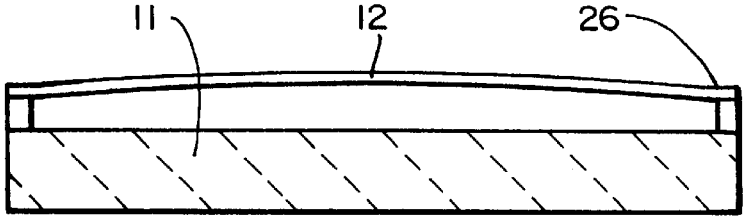
FIG. 13 is a cross-sectional view of FIG. 12 taken along the line 13—13 of FIG. 12.
Figure 14:
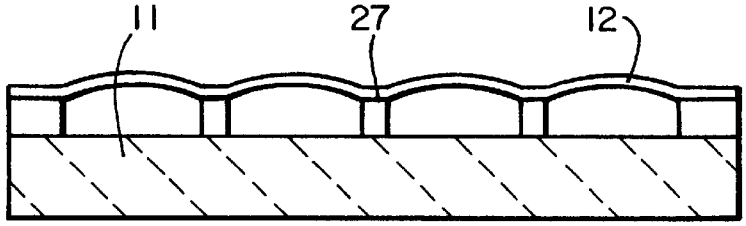
FIG. 14 is a cross-sectional view of the element of FIG. 12 taken along the lien 14—14 of FIG. 12.

The acoustic energy which is transferred to the substrate can be reduced by reducing the ratio of the length of the membrane support edges (perimeter of membrane and perimeter of post supports in tent membranes) to the membrane area. Referring to FIG. 12, a transducer element similar to that of FIG. 2 is shown. However, when the membranes are formed, the etching is such that the membranes merge to form a single membrane supported at its edges 26, and by posts 27. The acoustic energy transferred through the supports is substantially reduced because the length of the membrane support edges is reduced for the membrane area. Referring to the cross-sectional views, FIGS. 13 and 14, taken along the lines 13—13 and 14—14 of FIG. 12, it is seen that not only is the support length reduced to reduce cross-talk through the substrate, but the slope of the membranes at the edges is reduced to reduce ultrasonic waves propagating parallel to the surface at the fluid-solid interface.

Figure 15:
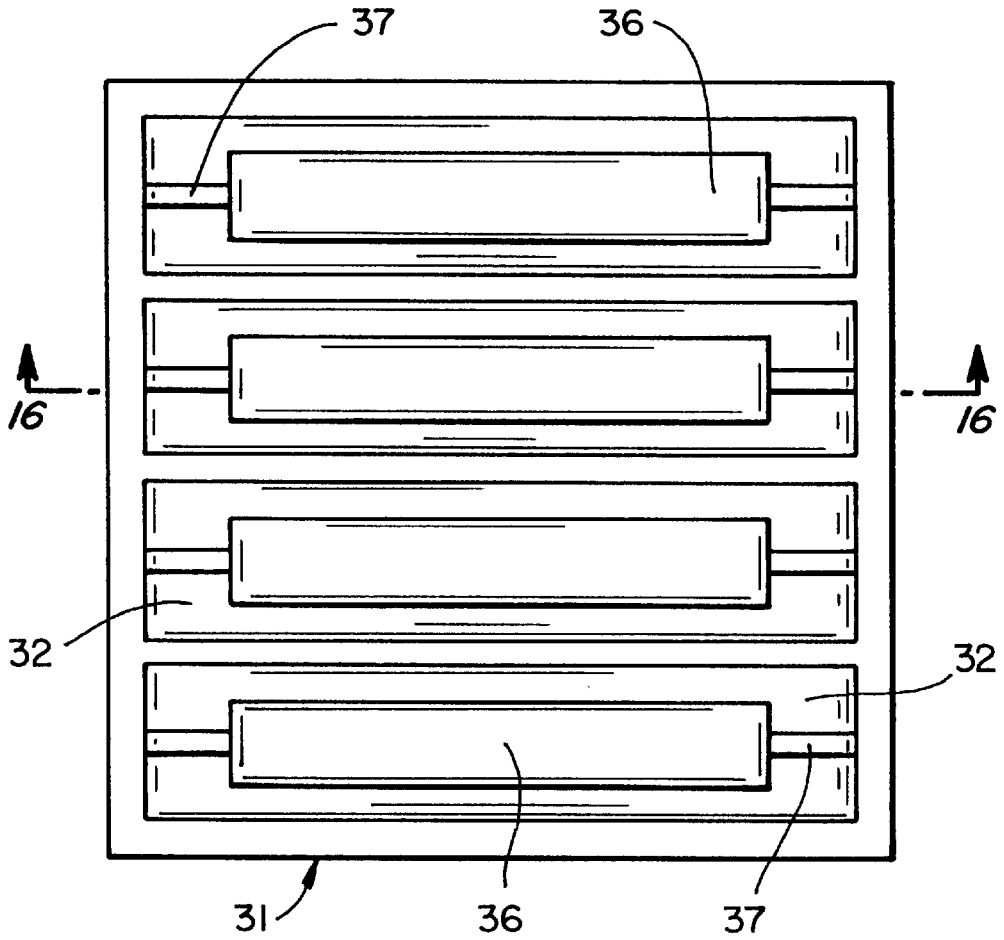
FIG. 15 is a plan view of a transducer element including rectangular membranes.
Figure 16:
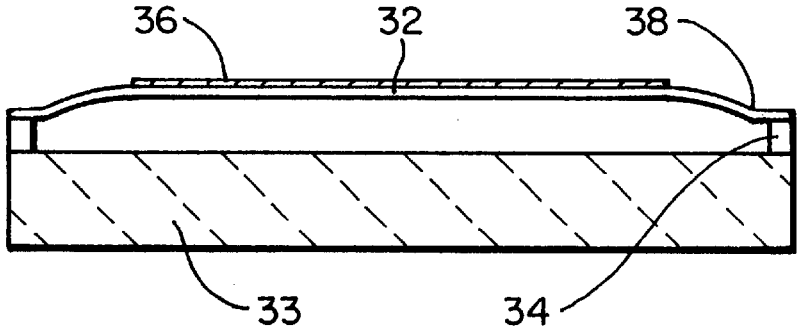
FIG. 16 is a sectional view of the transducer array of FIG. 15 taken along the line 16—16 of FIG. 15.

Excitation of surface waves can be reduced by employing rectangular membranes. FIGS. 15 and 16 show an array element 31 having a plurality of rectangular membranes 32 supported on substrate 33 by insulating supports 34. Electrodes 36 and leads 37 are also shown. The electrode 36 can be shaped to favor minimum slope of membrane displacement at the edges. Then, the edge displacement and fluid-solid interface wave cross-coupling is reduced because of the reduction of the slope of the membrane displacement 38 at the ends.

Figure 17:
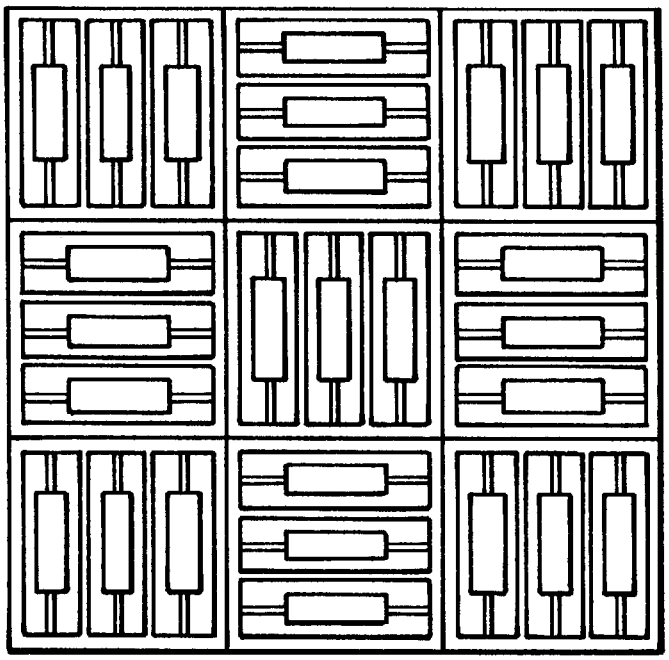
FIG. 17 is a plan view of a two-dimensional transducer array including elements of the type shown in FIG. 15.
Figure 18:
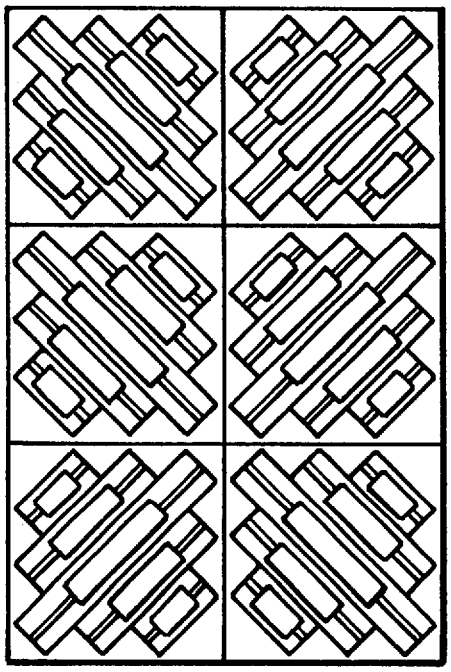
FIG. 18 is a plan view of a two-dimensional transducer array including elements of the type shown in FIG. 15 oriented in a different direction.
Figure 19:
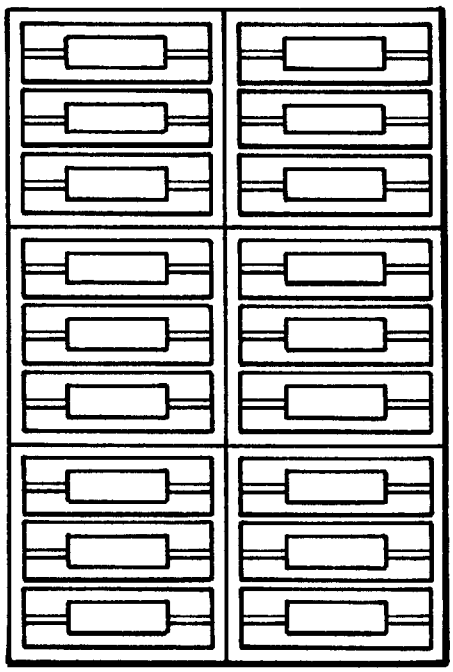
FIG. 19 is a plan view of a one-dimensional array of transducer elements of the type shown in FIG. 15.

Since the cross-coupling is reduced in the long direction of the membranes, the orientation of the rectangular membranes from transducer element to transducer element can be varied to reduce the cross-coupling of surface waves between neighboring elements. FIGS. 17 and 18 show possible orientations for two-dimensional arrays, while FIG. 19 shows possible orientation for a one-dimensional array.

There have been described several methods of reducing cross-coupling between single transducers and arrays of transducers. In the case of plate or Lamb waves, several approaches have been described, including changing the wafer thickness, interrupting the propagation path through the substrate, and reducing the membrane support area. In the case of surface waves, the shape and size of the membranes is controlled to reduce the slope of the membrane at the support edges between transducers.

What is claimed is:

1. A capacitive micromachined ultrasonic transducer array comprising a plurality of spaced transducer elements, each including at least one membrane formed on a substrate, said substrate having a thickness such that the critical angle of plate waves exceeds the desired acceptance angle of the ultrasonic transducer array elements to minimize the excitation and propagation of plate waves and to minimize the interaction of transducer elements with each other through the plate waves or ultrasonic waves propagating at the interface between the transducer array surface and the immersion fluid, and said membrane and its attachment to the substrate configured to minimize the excitation of plate waves and to minimize the interaction of transducer elements through the plate waves or ultrasonic waves propagating at the interface between the transducer array surface and the immersion fluid.

2. A capacitive micromachined ultrasonic transducer array as in claim 1 in which each transducer element includes a slot in the substrate surrounding each transducer element to interrupt the propagation of plate waves or ultrasonic waves propagating at the interface between the transducer array surface and the immersion fluid.

3. A capacitive micromachined ultrasonic transducer array as in claim 1 in which each transducer element includes a porous region in the substrate surrounding each transducer element to interrupt the propagation of plate waves.

4. A capacitive micromachined ultrasonic transducer array as in claim 1 in which the ratio of the length of membrane-supporting edge to the membrane area is minimized to minimize the transfer of ultrasonic energy from the membrane into the substrate.

5. A capacitive micromachined ultrasonic transducer array as in claim 1 in which the size of the membranes at the edge of the transducer element is reduced to minimize the slope of the membrane displacement along their edges to minimize the excitation and detection of ultrasonic waves propagating along the interface between the transducer array surface and the immersion fluid.

6. A capacitive micromachined ultrasonic transducer array as in claim 1 in which the membrane has a shape to minimize the slope of the membrane displacement along its edges to minimize the excitation and detection of ultrasonic waves propagating along the interface between the transducer array surface and the immersion fluid.

7. A capacitive micromachined ultrasonic transducer array as in claim 1 in which the electrode on the membrane is shaped to minimize the slope of the membrane displacement along its edges to minimize the excitation and detection of ultrasonic waves propagating along the interface between the transducer array surface and the immersion fluid.

8. A capacitive micromachined ultrasonic transducer array as in claim 1 or 7 in which the membranes and electrodes are rectangular.

9. A capacitive micromachined ultrasonic transducer array as in claim 8 in which the orientation of the membranes is varied from transducer element to transducer element to minimize the transfer of ultrasonic energy between the transducer elements through ultrasonic waves propagating at the interface between the transducer array surface and the immersion fluid.

10. A capacitive micromachined ultrasonic transducer array comprising a plurality of spaced transducer elements, each including at least one membrane formed on a substrate, said substrate includes a slot in the substrate surrounding each transducer element to minimize the excitation and propagation of plate waves and to minimize the interaction of transducer elements with each other through the plate waves or ultrasonic waves propagating at the interface between the transducer array surface and the immersion fluid, and said membrane and its attachment to the substrate configured to minimize the excitation of plate waves and to minimize the interaction of transducer elements through the plate waves or ultrasonic waves propagating at the interface between the transducer array surface and the immersion fluid.

11. A capacitive micromachined ultrasonic transducer array comprising a plurality of spaced transducer elements, each including at least one membrane formed on a substrate, said substrate includes a porous region in the substrate surrounding each transducer element to minimize the excitation and propagation of plate waves and to minimize the interaction of transducer elements with each other through the plate waves or ultrasonic waves propagating at the interface between the transducer array surface and the immersion fluid, and said membrane and its attachment to the substrate configured to minimize the excitation of plate waves and to minimize the interaction of transducer elements through the plate waves or ultrasonic waves propagating at the interface between the transducer array surface and the immersion fluid.

12. A capacitive micromachined ultrasonic transducer array comprising a plurality of spaced transducer elements, each including at least one membrane formed on a substrate, said substrate configured to minimize the excitation and propagation of plate waves and to minimize the interaction of transducer elements with each other through the plate waves or ultrasonic waves propagating at the interface between the transducer array surface and the immersion fluid, and said membrane having the ratio of the length of membrane-supporting edge to the membrane area minimized to minimize the transfer of ultrasonic energy from the membrane into the substrate to minimize the excitation of plate waves and to minimize the interaction of transducer elements through the plate waves or ultrasonic waves propagating at the interface between the transducer array surface and the immersion fluid.

13. A capacitive micromachined ultrasonic transducer array comprising a plurality of spaced transducer elements, each including at least one membrane formed on a substrate, said substrate configured to minimize the excitation and propagation of plate waves and to minimize the interaction of transducer elements with each other through the plate waves or ultrasonic waves propagating at the interface between the transducer array surface and the immersion fluid, and said membranes having a reduced size at the edge of the transducer array to minimize the slope of the membrane displacement along their edges to minimize the excitation and detection of ultrasonic waves propagating along the interface between the transducer array surface and the immersion fluid and its attachment to the substrate configured to minimize the excitation of plate waves and to minimize the interaction of transducer elements through the plate waves or ultrasonic waves propagating at the interface between the transducer array surface and the immersion fluid.

14. A capacitive micromachined ultrasonic transducer array comprising a plurality of spaced transducer elements, each including at least one membrane formed on a substrate, said substrate configured to minimize the excitation and propagation of plate waves and to minimize the interaction of transducer elements with each other through the plate waves or ultrasonic waves propagating at the interface between the transducer array surface and the immersion fluid, and said membranes having a shape to minimize the slope of the membrane displacement along its edges to minimize the excitation and detection of ultrasonic waves propagating along the interface between the transducer array surface and the immersion fluid, and their attachment to the substrate configured to minimize the excitation of plate waves and to minimize the interaction of transducer elements through the plate waves.

15. A capacitive micromachined ultrasonic transducer array comprising a plurality of spaced transducer elements, each including at least one membrane formed on a substrate, said substrate configured to minimize the excitation and propagation of plate waves and to minimize the interaction of transducer elements with each other through the plate waves or ultrasonic waves propagating at the interface between the transducer array surface and the immersion fluid, said membrane and its attachment to the substrate configured to minimize the excitation of plate waves and to minimize the interaction of transducer elements through the plate waves or ultrasonic waves propagating at the interface between the transducer array surface and the immersion fluid, and electrodes on the membranes shaped to minimize the slope of the membranes' displacement along their edges to minimize the excitation and detection of ultrasonic waves propagating along the interface between the transducer array surface and the immersion fluid.

* * * * *